US005123931A

United States Patent [19]

Good et al.

[11] Patent Number: 5,123,931

[45] Date of Patent: Jun. 23, 1992

[54] COAL RECOVERY PROCESS

[75] Inventors: Robert J. Good, Grand Island; Mohan Badgujar, Williamsville, both of N.Y.

[73] Assignee: The Research Foundation of State University of NY, Albany, N.Y.

[21] Appl. No.: 623,121

[22] Filed: Dec. 6, 1990

[51] Int. Cl.[5] ..... C10L 1/32

[52] U.S. Cl. ..... 44/281; 44/280; 44/505; 44/622; 252/60; 252/61

[58] Field of Search ..... 44/280, 281, 505, 622; 252/60, 61

[56] References Cited

U.S. PATENT DOCUMENTS

| | | | |
|---|---|---|---|
| 3,988,120 | 10/1976 | Chia | 44/622 |
| 4,426,281 | 1/1984 | Meyers et al. | 252/60 |
| 4,484,928 | 11/1984 | Keller, Jr. | 44/574 |
| 4,702,824 | 10/1987 | Abadi | 252/61 |
| 4,770,766 | 9/1988 | Keller, Jr. et al. | 44/620 |
| 5,030,340 | 7/1991 | Panzer | 252/61 |

OTHER PUBLICATIONS

*Kirk-Othmer Encyclopedia of Chemical Technology*, 3rd Edition, vol. 6, pp. 266-267, 1979.

Van Nostrand Reinhold Encyclopedia of Chemistry, 4th Edition, 1984, p. 793.

*Primary Examiner*—Prince Willis, Jr.

*Assistant Examiner*—Thomas Steinberg

*Attorney, Agent, or Firm*—Bean, Kauffman & Spencer

[57] ABSTRACT

A method for the beneficiation of coal by selective agglomeration and the beneficiated coal product thereof is disclosed wherein coal, comprising impurities, is comminuted to a particle size sufficient to allow impurities contained therein to disperse in water, an aqueous slurry is formed with the comminuted coal particles, treated with a compound, such as a polysaccharide and/or disaccharide, to increase the relative hydrophilicity of hydrophilic components, and thereafter the slurry is treated with sufficient liquid agglomerant to form a coagulum comprising reduced impurity coal.

38 Claims, No Drawings

COAL RECOVERY PROCESS

This invention relates to an improved process for enhancing the reduction of ash and impurities, particularly mineral impurities such as those containing sulfur, from raw coals by selective agglomeration. The invention described herein was made in the course of work performed under a grant or award from the Department of Energy, particularly DOE contract #DE-AC22-87PC79905.

BACKGROUND OF THE INVENTION

The removal of impurities from raw coal fuels has taken on increasing importance in the modern world. The effect of impurities entering the earth's atmosphere from the burning of raw coal as a fuel has been so serious that private interests and governmental authorities have been taking increased action to prevent its continued occurrence. Coal-using facilities have, voluntarily and involuntarily through government mandate, been searching for ways to reduce impurities released to the atmosphere through the burning of coal. As a result of such search, new means have been developed for the cleaning and recycling of coal by-products, while the use of impurity-laden raw coals has been reduced, and efforts to reduce impurities in raw coal fuels have increased.

Raw coal is a term generally used in the art as constituting a feedstock which contains carbonaceous coal and mineral matter deposited therewith, from a typical natural coal deposit. By the term carbonaceous coal is meant the carbon-rich component of raw coal, essentially free of mineral impurities.

As might be expected, relatively impurity-free, clean-burning, raw coal is less available and more costly to obtain than relatively impurity-laden raw coals. Thus, in recent years efforts have been mounted to find economical processes to treat relatively impurity-laden raw coal to a quality that can be conveniently used in replacement, or as an adjunct to, relatively clean burning coals. Such processes are generally referred to as beneficiation processes; and raw coal which has been beneficiated to a reduced percentage of impurities such that it comprises a higher percentage of carbonaceous coal is generally referred to as coal product.

A means for treating raw coal to remove impurities, that has been of interest to the coal industry, is the selective agglomeration process. In such process, impurities are removed from raw coal, before burning, by a series of manipulative steps wherein the raw coal is treated with an agglomerant to separate impurities from the carbonaceous coal. Typically, a raw coal is treated in liquid medium, such as water, and impurities or coal product are selectively agglomerated and removed from the medium. The agglomerated coal product or agglomerated impurities may typically be thereafter treated to remove liquid medium that may be present in the agglomerated mass and/or to separate the coal product or the impurities from the agglomerant. Generally it is desirable to recycle the agglomerant; and the coal product may or may not be further treated before it is suitable for use as a clean burning fuel.

One particular agglomeration process, known as the Otisca T-Process and described in U.S. Pat. No. 4,484,928, treats comminuted raw coal in a liquid medium comprising an aqueous slurry by mixing an agglomerating agent with a slurry of comminuted raw coal, until coal-containing particles are coalesced into agglomerates. The agglomerates are recovered dispersing in clean water and re-agglomerating the coal particles and/or subjecting the coal particles to an acid leach.

The Otisca T-Process has been generally seen as a promising, commercially economical treatment of impurity laden raw coal, but it is generally recognized that there is further need for reducing the impurity content, particularly pyrite and ash content, of the resulting coal product.

U.S. Pat. No. 4,249,699 seeks to reduce pyrite and other mineral contamination in agglomeration processes by using select organic liquid agglomerating additives, particularly fluorocarbon additives, and adding calcium oxide to comminuted raw coal slurry during the agglomeration process. Calcium oxide is seen by the patent as appearing to inhibit the ability of pyritic material in the slurry to agglomerate along with the coal product, though the mechanism is apparently not fully understood.

U.S. Pat. No. 4,770,766 discloses a modification of the Otisca T-Process, that provides new agglomerating additives that allow shortened residence time of the agglomeration step to accommodate high tonnage semi-continuous and/or continuous processing. In this modified process an additive is pre-blended with the aqueous slurry, or with the liquid agglomerant, which is seen as causing the surface of the coal product to act as if the difference in interfacial tension between the coal product particles and the aqueous carrier of the slurry, were higher. The patent asserts that the pre-blended additive reduces the agglomeration time associated with the Otisca T-Process without decreasing the ability of the process to exclude mineral matter from the coal product. To be usable for this process, the patent requires that the additive have a molecular oxygen content in the range of 9 to 16 weight percent based on the total molecular weight of the compound.

Interestingly, in another aspect of U.S. Pat. No. 4,770,766, the patent discloses the use of additives which are seen as delaying the onset of agglomeration of the coal particles. Apparently these delaying additives are seen by the patent as dispersants that reduce the viscosity of the slurry. A non-ionic dispersant, dextrin, is disclosed as being preferred for use as an additive which will delay agglomeration and Example VII of the patent provides experimental data tending to support the premise that various additives, such as dextrin, may increase the time it takes for an agglomerate to act when used at additive levels of 500 ppm and greater.

The scientific paper "Depression of Coal By Starches And Starch Derivatives", by C.J. Im and F.F. Aplan, published as proceedings of the First Australian Coal Preparation Conference held in April, 1981, describes the effect of various starches, on the depression of floatation of hydrophobic coal particles. Therein it is disclosed that starches, in exemplified concentrations of about 300 ppm and more, are effective in depressing floatation of hydrophilic coal particles, and as such appear to have utility in systems wherein it is desirable to float refuse constituents from coal. It is significant to note that the paper points out that "nearly all pyrite depressants are also coal depressants at a similar or somewhat higher depressant concentration".

An object of the present invention is to provide an improved agglomeration process for the beneficiation of coal.

Another object of the present invention is to provide a beneficiated coal having decreased mineral content from the raw coal source.

A still further object of the present invention is to provide a beneficiated coal having a decreased pyrite and/or ash content.

These and other objects of the invention will become apparent from the following description of the invention.

SUMMARY OF THE INVENTION

The present invention relates to a method for reducing the impurity content of raw coal, particularly mineral impurities, comprising: comminuting impurity containing coal to a particle size sufficient to allow impurities contained therein to disperse in water; forming a slurry comprising said comminuted coal, water and dispersed impurities in a weight ratio of coal:water of from about 1:5 to about 1:50; treating said slurry with an amount of a hydrophilic compound sufficient to increase the relative hydrophilicity of impurities dispersed in said slurry to the relative hydrophobicity of carbonaceous coal; contacting said slurry having increased relative hydrophilicity of impurities with sufficient liquid agglomerant to form agglomerant coalesced with hydrophobic comminuted coal; and recovering agglomerant coalesced with hydrophobic comminuted coal.

The method of the invention is effective as an improvement to the Otisca T-Process, particularly for reducing pyrite content, but also for decreasing the ash content of the beneficiated coal. The invention comprises the process as it may stand alone as an agglomeration process, as well as that it may encompass improvement to existing agglomeration processes, and includes the beneficiated coal product thereof.

DETAILED DESCRIPTION OF THE INVENTION

Typically, raw coal is preliminarily prepared at the mining site by cleaning and/or screening such that it comprises pieces and/or chunks of carbonaceous coal having impurities deposited therewith, but with the gross impurities, that may have commingled with the pieces and/or chunks during mining operations, generally removed. Typically the impurities deposited with the carbonaceous coal constitute mineral matter such as clay, slate, shale, sulfur compounds such as pyrite and the like.

In the process of the present invention, raw coal, which typically has been preliminarily prepared, is subjected to various treatment steps that have the effect of separating non-desirable impurities from carbonaceous coal and providing a liquid medium in which the carbonaceous coal can be isolated and conveniently recovered. The process achieves this by first forming the raw coal into discrete particles, a preponderance of which individually have higher carbonaceous coal content than the gross raw coal. The bulk particulate mass, containing such higher carbonaceous coal content particles, is treated in liquid medium to optimize the distinction of identity of those particles that have a higher carbonaceous coal content, and the optimized particulate mass, in liquid medium, is then treated to selectively agglomerate the higher carbonaceous coal content particles. The agglomerated particles are thereafter separated from the particulate mass.

In order to form the raw coal into discrete particles that individually have higher carbonaceous coal content than the raw coal mass, it is essential that the raw coal be comminuted sufficiently to produce particulate matter that can be characterized as being of a size such that a preponderance of the particles have a surface area containing a ratio of carbonaceous coal to impurity which renders the particles identifiably hydrophobic or hydrophilic. To achieve such identifiable hydrophobicity or hydrophilicity, the particle size should ideally approach the particle size of the impurities in the carbonaceous coal, so that a preponderance of particles which contain impurities have an exposed surface area containing mainly such impurities, while a preponderance of particles containing carbonaceous coal have an exposed surface area containing mainly such carbonaceous coal. In addition, the particle size should approach a size which will allow dispersal of the particles in liquid sufficient to form a slurry.

In general it has been found that for typical raw coal feedstock, average particle sizes generally less than about 50 microns are suitable to achieve the desired preponderance and allow dispersal in liquid. It is preferred however that the average comminuted particle size be from about 2 to about 40 microns when utilizing an aqueous agglomeration medium and most preferably below about 20 microns.

Comminuting the raw coal feedstock can be achieved by a number of methods known in the art, such as impact milling, ball milling, race milling or the like, by dry and/or wet grinding processes. Typically such milling is accomplished in a wet grinder and the ground particles are transferred to a slurry vessel or dynamic moving slurry bed, as may be appropriate to the operation of the facility. It should be understood that the particles need not purposely have been comminuted for the process of the invention, but may be particles already existing from a slurry pond, hydrobeneficiation plant, or the like.

The liquid medium in which the particles are treated is preferably an aqueous medium comprising an aqueous slurry. An aqueous slurry formed from the particles can generally be in a weight ratio of particles:water of from about 1:5 to about 1:50, respectively. Generally, however, it is desirable to reduce the volume of water used in the process and thus typically it is preferred that the weight ratio be from about 1:15 to about 1:25, and most preferred to be about 1:20.

The addition of an appropriate hydrophilic compound in accord with the method of the present invention is made in an amount sufficient to increase the relative hydrophilicity of particles containing impurities, dispersed in the slurry, without appreciably affecting the hydrophobicity of particles containing high percentages of carbonaceous coal. Though applicants do not wish to be bound by the following, it is believed that the comminuting of a raw coal to a particle size within the range of the invention provides a preponderance of particles that have either a very high percentage carbonaceous coal or very high percentage impurity. Generally, particles having a hydrophobic characteristic comprise a high percentage of carbonaceous coal and particles having a slight to highly hydrophilic characteristic contain increasing percentages of impurity relative to carbonaceous coal. In agglomeration processes, the agglomerating agent typically acts selectively to agglomerate hydrophobic particles, but slightly hydrophilic particles appear ofttimes to be trapped within the bridges formed in the agglomerate and bring their impurity content to the final beneficiated coal product. Thus, an additive which increases the hydrophilicity of slightly hydrophilic particles, without significantly affecting the hydrophobicity of existing hydrophobic particles, would appear to sharpen the line of hydrophilicity demarcation between impurity laden particles and relatively impurity free particles by reducing the incidence of slightly hydrophilic particles. Such reduction in slightly hydrophilic particles in turn reduces the availability of impurity containing particles which may be trapped within bridges that may be formed in the agglomerate mass and thus reduces the impurity content of the beneficiated coal product.

Hydrophilic compounds which have been found particularly effective in the process of the present invention include gelatin and the saccharides, particularly the polysaccharides at very low additive levels and the monosaccharides, disaccharides and trisaccharides at significantly higher additive levels.

The addition of an appropriate saccharide and/or gelatin in accord with the method of the present invention appears to have the effect of increasing the hydrophilicity of slightly hydrophilic particles without significant effect on hydrophobic particles. The particles with thus increased hydrophilicity appear to be less susceptible to being trapped within the bridges formed within the agglomerant, and this has the effect of decreasing the percentage of impurities recovered with the agglomerated coal product.

Mono-, di-, tri- and polysaccharides have generally been found effective in the process of the invention, with the disaccharides and polysaccharides being preferred and the polysaccharides being most preferred.

Typical monosaccharides which appear to be effective in the process of the invention include the tetroses such as erythrose; pentoses such as arabinose, xylose, ribose and lyxose; hexoses, for example the aldohexoses such as glucose, galactose, mannose, gulose, idose, talose, altrose and allose, and for example the ketohexoses such as fructose, sorbose and tagatose.

Typical disaccharide sugars which appear to be effective in the process of the invention have the general formula $C_{12}H_{22}O_{11}$. Typical compounds included therein include sucrose, lactose, maltose, melibiose, cellobiose and trehalose. Preferred disaccharide sugars are non-ionic compounds of the general formula such as sucrose, lactose and maltose.

Typical trisaccharides which appear to be effective in the process of the invention have the general formula $C_{18}H_{32}O_{16}$ and include compounds such as raffinose.

A wide range of polysaccharide compounds appear to be effective in the process of the present invention. By the term polysaccharide is meant a compound of the general formula $(C_6H_{10}O_5)_n$. Typical compounds included therein include the non-sugars such as starches, cellulose, cellulose derivatives, dextrin, inulin, glycogen and pentosans. Preferred polysaccharide compounds are nonionic, branched compounds of the general formula, which form a hydrophilic colloid with water and wherein n is greater than about 3, particularly including the starches and dextrin.

Generally, appropriate polysaccharides include the corn starches, particularly including those commercially known as CPC 3372, 3008, 3350, 3353, 3372, 6400, 3005 and 6448, A-100 Pure Food Starch, Waxy Maize no. 1, Amioca, (amylopectin) Hylon VII, (High any loose starch) Hamaco 267, 277 and 297, C-165, Cato 2, 14 and 15, (amphoteric corn starch) Lok-size 60, Sta-lok 1302 and 1303; the potato starches, such as those known as Potato Starch, Hamaco 196 gum, Sta-lok 400 and Floc Aid 1063; the Tapioca and cassava starches, including those known as Benefit T; and, the wheat starches such as those known as Kesco 8, SDU, Supergell 1202 and EXD-12. Boiled starches have been found to be particularly effective; however, boiling of a starch in water over 120° Centigrade typically causes dextrin to be formed. In some cases, boiled starches may be allowed to age before use for best results.

Typical appropriate dextrins include the generally known corn, potato, tapioca and wheat dextrine such as those known as Dextrin 7022, 7071, 8003, 8032 and 8071; Stadex 15, 20, 92, 106 and 128; Nadex 525; Potato 205; Staley 11 and 105; WW 82 and 92; WC 9524; and Hycon D-05.

It should be understood that various starch derivatives may be appropriate polysaccharides for use in the invention, including the British gums, such as Sta-Dex 140 and the oxidized, pyrolized rearranged starch polymers, such as the Stayco S and M derivatives, Staramic 330, Micro-clear 340 and the like.

The amount of saccharide and/or gelatin compound that is added to the slurry in accord with this invention is that amount which will increase the hydrophilicity of impurity containing particles without significant effect upon the hydrophobicity of carbonaceous coal containing particles. The maximum amount of compound that should be added to the aqueous slurry in accord with this invention is dependent upon the tolerance of the high carbonaceous coal content particles to reduction in hydrophobicity. As disclosed in the scientific paper "Depression Of Coal By Starches and Starch Derivatives", identified aforesaid, starches are generally known as having the effect of depressing the floatation of coal particles in aqueous slurry froth floatation processes. It is generally believed that the mechanism of such depression is to render typically hydrophobic floatable particles so hydrophilic as to settle downward in the slurry, without attachment to gas bubbles.

Applicants have found, in liquid agglomeration processes, that if the amount of starch in a slurry is kept below a concentration that modifies the interfacial contact angle so much as to depress floatation of particular high carbonaceous coal content particles, there still appears to be enough starch in the slurry to increase the hydrophilicity of impurity containing hydrophilic particles. Thus, in liquid agglomeration processes, more strongly hydrophobic coal particles will tolerate higher concentrations of polysaccharide compounds such as starch, while less hydrophobic coals will require lower concentrations.

Generally, the concentration of polysaccharide and/or gelatin addition operable for use in the invention in a typical raw coal slurry is below about 300 ppm, preferably below about 250 ppm and most preferably below about 150 ppm.

The amount of mono-, di- or tri- saccharide that is added to the slurry in accord with the process of the present invention, typically must be significantly greater than the amount of polysaccharide or gelatin that would be added. Generally the concentration of mono-, di- or tri- saccharide that must be attained in the raw coal slurry is above about 400 ppm, preferably above about 5,000 ppm and most preferably about 10,000 ppm.

Addition of the saccharide and/or gelatin can occur at any convenient time, though it is preferred that addition take place prior to the addition of agglomerating additives. Typically, the addition of the saccharide and/or gelatin is followed by a conditioning period wherein the additive is allowed to adsorb to the impurities. Such period is typically from a few seconds to 10 minutes or more. Thus, the saccharide or gelatin can be added to the particulate mass prior to the formation of the slurry, may be added to the water prior to or coincident with the formation of the slurry, or may be added after the slurry has been formed and/or after agglomerating additives have been added. In the preferred process of the invention, the slurry of water and particles is formed and saccharide or gelatin is added prior to the addition of an agglomerating agent, while maintaining the slurry agitated.

Generally, the agglomerating agents known in the prior art as effective for agglomerating hydrophobic coal have been found suitable in the process of the present invention. Preferred however are the liquid hydrocarbons, particularly pentane, cyclopentane, hexane, cyclohexane, heptane, decane, tetralin, decalin, fuel oil #1, fuel oil #6 and mixtures thereof.

Other additives may be added prior to, after, or coincident with the saccharide or gelatin. With various raw coal feedstocks, it may be desirable to increase the hydrophobicity of the coal particles by the addition o additives such as octanol or castor oil and the like. Such additives typically act to condition the coal particles in the slurry so that they have increased hydrophobicity, thus allowing the addition of increased saccharide and/or gelatin and further reducing the presence of slightly hydrophilic impurities.

The following examples are provided to illustrate the invention and are not meant to comprise a limitation thereto.

A number of experiments were run to determine the effect of the addition of saccharides and gelatin to raw coal to be treated by agglomeration processing.

Three sources of coal were investigated: Upper Freeport coal, Kentucky No. 9 coal and Illinois No. 6 coal. Samples of each of the above coals were preliminarily cleaned and screened at the mining site to remove gross impurities. The cleaned raw coal was comminuted to a particle size small enough to pass through a 10 micron screen, by wet ball milling. The comminuted coal was stored in water, under a nitrogen blanket, until used in the experiments. Coal:water slurries were prepared using settled out coal, from storage, in a 1:20 weight ratio, respectively. The water used for forming the slurry was distilled water, and a Waring type blender was used to maintain the particles agitated. The pH of the slurry was checked upon preparation of the slurry, and adjustments were made using an acid or base as necessary to maintain the pH at a desired level.

Each of the so prepared raw coal slurries was subjected to typical Otisca T-Processing using n-pentane as the agglomerating additive. Slurry samples of each of the three coals were first run without hydrophilic additive and the agglomerated coal product was analyzed. The parameters identified in the analysis were total percent ash, total sulfur content and pyritic sulfur content. Slurry samples of the raw coals were prepared using saccharides at differing percentage addition. The saccharide or gelatin was added to the slurry prior to the addition of the agglomerating additive. If an additive to increase the hydrophobicity of the coal particles was used, such as n-octanol or castor oil, it was added together with the agglomerant.

The slurry containing the coal particles, gelatin or saccharide, agglomerating agent and other additives was then subjected to high speed blending using the Waring blender until an end point was reached. The end point, for purposes of the experiments, was determined to be that point in the formation of an agglomerate when the stirred liquid slurry changed from a uniform black or dark gray to a pale, dirty gray color with lumps visible therein. After the end point was reached, the agitation was typically continued for about a minute at the lowest speed of the blender, to improve the formation of larger lumps.

The resulting aqueous suspension was typically poured over a 120 mesh wire screen and the coagulum was washed several times with water. The washed coagulum was then pressed and thereafter dried to evaporate pentane and water remaining therein. Dried coagulum was sent to independent laboratories for analysis of ash, total sulfur and pyritic sulfur content by standard analytical procedures.

Tables 1–8 set out data obtained from the process of the invention, applied to the three above identified coal samples. All analyses were reported in weight percent. The ash values are reported on a moisture-free (MF) basis and the sulfur values are reported on a moisture-free and ash-free (MAF) basis.

The percent reduction of ash was determined by measuring the difference between the percent weight of ash content found in the coal product agglomerated without additive (the base line analyses designated "none" in each table) and the percent weights of ash in the coal product agglomerated with additive. The difference was divided by the respective percent weights found in the coal product agglomerated without additive and multiplied by 100.

The percent improvement in reduction of pyritic sulfur was calculated as follows. Initially, the raw coal was analyzed to separately determine total raw coal sulfur content and raw coal pyritic and sulfate sulfur content in weight percent. Raw coal organic sulfur content was then calculated as being the weight percent difference between the raw coal pyritic and sulfate sulfur content and the raw coal total sulfur content for purposes of comparison.

After the raw coal was processed, the coal product was analyzed for total sulfur content in weight percent. Pyritic sulfur content of the coal product was then calculated as being the difference between the weight percent raw coal organic sulfur content which had been previously calculated and the weight percent of total sulfur as determined by analysis of the coal product.

The percent reduction of pyritic sulfur was calculated by finding the difference in weight percent between the pyritic sulfur calculated as found in the product coal processed without additives and pyritic sulfur calculated as found int he product coal processed with additives, dividing the difference by the content of pyritic sulfur calculated as found int he product coal processed without additives, and multiplying by 100.

In Tables 1 and 4, Upper Freeport coal was agglomerated using n-pentane at a pH adjusted to 7.0. A polysaccharide or gelatin additive was added to the slurry and the slurry was conditioned by agitation for about 10 minutes before addition of the agglomerant. No other additives were used.

In table 2, Upper Freeport coal was agglomerated using n-pentane at a pH adjusted to 7.0. A polysaccharide additive was added to the slurry and the slurry was conditioned for 10 or 20 minutes, as indicated in parenthesis adjacent the identification of the additive, before addition of the agglomerant.

In table 3, Upper Freeport coal was agglomerated using n-pentane at a pH adjusted to 8.2. A polysaccharide additive was added to the slurry and the slurry was conditioned for 10 or 20 minutes, as indicated in parenthesis adjacent the identification of the additive, before addition of the agglomerant.

In table 5, Kentucky #9 coal was agglomerated using n-pentane at a pH adjusted to 8.2. A polysaccharide additive was added to the slurry and the slurry was conditioned for 20 minutes before addition of the agglomerant together with 0.8–1.25 weight percent octanol hydrophobicity additive. The slurry was made from tap water, where (TW) is designated adjacent the additive.

In table 6, Illinois #6 coal was agglomerated using n-pentane at a pH adjusted to 8.0. A polysaccharide additive was added to the slurry and the slurry was conditioned for 10 minutes before addition of the agglomerant together with 0.8 weight percent castor oil hydrophobicity additive. The baseline analysis, designated "none" in the table, for percent ash, total sulfur and pyrite sulfur is an average of two results of runs in which there was no saccharide or gelatin addition.

In table 7, Illinois #6 coal was agglomerated using n-pentane at pH adjusted to 8.0 or 9.0 to determine the affect of pH changes. A polysaccharide additive was added to the slurry and the slurry was conditioned for 10 minutes before addition of the agglomerant together with 0.8 weight percent castor oil hydrophobicity additive. Comparisons were made between runs at like pH's. The analysis reported for percent ash, total sulfur and pyrite sulfur in the raw coal is an average of two sets of results. The data obtained is an average of multiple runs as indicated in the table.

In table 8, Upper Freeport coal was agglomerated using n-pentane at pH adjusted to 7.0. Disaccharide was added to the slurry and the slurry was conditioned for 10 minutes before addition of the agglomerant.

The data shows a significant reduction of pyritic sulfur and ash when the slurry was treated with saccharide or gelatin as compared to without such treatment.

TABLE 1

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| Raw Coal* Analysis | — | — | 19.40 | 2.55 | 1.87 | — | — |
| None | — | 0.62 | 5.09 | 1.39 | 0.713 | — | — |
| Amioca | 33 | 2.0 | 4.22 | 1.138 | 0.458 | 17.1 | 35.8 |
| Amioca | 67 | 4.0 | 3.78 | 1.081 | 0.401 | 25.7 | 43.8 |
| CPC 3005 | 100 | 3.0 | 3.93 | 1.124 | 0.444 | 22.8 | 37.7 |
| CPC 3372 | 33 | 0.8 | 4.51 | 1.236 | 0.556 | 11.4 | 22.0 |
| CPC 3372 | 67 | 3.0 | 4.03 | 1.084 | 0.404 | 20.8 | 43.3 |

TABLE 1-continued

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|

*Contains 0.68% organic sulfur.

TABLE 2

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| Raw Coal* Analysis | — | — | 19.40 | 2.55 | 1.87 | — | — |
| None | — | 0.8 | 5.51 | 1.60 | 0.92 | — | — |
| CPC 3005 (10) | 100 | 3.5 | 4.34 | 1.241 | 0.561 | 21.2 | 39.0 |
| CPC 3005 (10) | 50 | 2.6 | 3.95 | 1.165 | 0.485 | 28.3 | 47.3 |
| CPC 3005 (20) | 100 | 3.3 | 3.75 | 1.129 | 0.449 | 32.0 | 51.2 |
| CPC 3005 (20) | 50 | 1.3 | 4.18 | 1,179 | 0.499 | 24.1 | 45.8 |

*Contains 0.68% organic sulfur.

TABLE 3

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| Raw Coal* Analysis | — | — | 19.40 | 2.55 | 1.87 | — | — |
| None | — | 0.9 | 4.76 | 1.466 | 0.786 | — | — |
| CPC 3005 (10) | 100 | 3.5 | 5.06 | 1.32 | 0.64 | (6.3)[1] | 18.6 |
| CPC 3005 (10) | 50 | 1.0 | 4.13 | 1.208 | 0.528 | 13.2 | 32.8 |
| CPC 3005 (20) | 100 | 3.0 | 3.90 | 1.178 | 0.498 | 18.1 | 36.6 |
| CPC 3005 (20) | 50 | 1.2 | 4.08 | 1.230 | 0.55 | 14.3 | 30.0 |

*Contains 0.68% organic sulfur.
[1]percent increase over base line.

TABLE 4

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| Raw Coal* Analysis | — | — | 19.40 | 2.55 | 1.87 | — | — |
| None | — | 0.7 | 4.61 | 1.31 | 0.63 | — | — |
| CPC 8071 | 50 | 3.8 | 3.82 | 1.07 | 0.39 | 17.1 | 38.1 |
| Cato 15 | 50 | 4.0 | 4.42 | 1.036 | 0.356 | 4.1 | 43.5 |

TABLE 4-continued

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| None** | — | 0.6 | 5.09 | 1.393 | 0.713 | — | — |
| Gelatin*** | 33 | 2.3 | 4.81 | 1.25 | 0.570 | 5.5 | 20.1 |

*Contains 0.68% organic sulfur.
**Average of four tests.
*Compared to None average.

TABLE 5

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| Raw Coal* Analysis | — | — | 10.40 | 4.55 | 2.55 | — | — |
| None | — | 0.8 | 4.27 | 3.60 | 1.60 | — | — |
| Hylon VII | 200 | 0.8 | 3.58 | 3.10 | 1.10 | 16.2 | 31.3 |
| Amioca | 67 | 1.2 | 3.10 | 2.72 | 0.72 | 27.4 | 55.0 |
| None (TW) | | 0.8 | 3.50 | 2.89 | 0.89 | — | — |
| Hylon VII (TW) | 200 | 0.8 | 3.38 | 2.82 | 0.82 | 3.4 | 7.9 |
| Amioca (TW) | 67 | 1.4 | 3.22 | 2.69 | 0.69 | 8.0 | 22.5 |

*Contains 2.00% organic sulfur.

TABLE 6

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| Raw Coal* Analysis | — | — | 18.0 | 4.86 | 2.69 | — | — |
| None | — | 0.8 | 3.695 | 3.349 | 1.179 | — | — |
| Amioca | 50 | 2.3 | 3.23 | 3.028 | 0.858 | 12.6 | 27.2 |
| CPC 8071 | 100 | 1.0 | 3.47 | 3.066 | 0.896 | 6.1 | 24.0 |
| CPC 3372 | 50 | 2.3 | 2.87 | 3.078 | 0.908 | 22.3 | 23.0 |
| Gelatin | 50 | 3.3 | 3.48 | 3.119 | 0.949 | 5.8 | 19.5 |

*Contains 2.17% organic sulfur.

TABLE 7

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| Raw Coal* Analysis | — | — | 18.0 | 4.86 | 2.69 | — | — |
| None (pH 9)[1] | — | 0.8 | 4.31 | 3.684 | 1.514 | — | — |
| None (pH 8)[2] | — | 0.8 | 4.416 | 3.812 | 1.642 | — | — |
| Amioca (pH 8) | 67 | 0.8 | 3.90 | 3.08 | 0.91 | 11.78 | 44.6 |

TABLE 7-continued

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| CPC 3372[1] (pH 8) | 67 | 0.8 | 3.90 | 3.445 | 1.275 | 11.78 | 22.4 |
| Amioca[2] (pH 9) | 67 | 1.4 | 3.63 | 3.158 | 0.988 | 15.88 | 34.7 |

*Contains 2.17% organic sulfur.
[1]Average, taken from two runs.
[2]Average, taken from three runs.

TABLE 8

| ADDITIVE | CONC. (PPM) | Aggl Time (MIN) | ANALYSIS wt % ASH | Total SULFUR | Pyrite SULFUR | Reduction % ASH | Pyrite SULFUR |
|---|---|---|---|---|---|---|---|
| Raw Coal* Analysis | — | — | 19.4 | 2.55 | 1.87 | — | — |
| None | — | 0.6 | 5.09 | 1.393 | 0.713 | — | — |
| Sucrose | 200 | 0.62 | 5.12 | 1.349 | 0.669 | 0.0 | 6.2 |
| Sucrose | 400 | 0.62 | 4.96 | 1.305 | 0.625 | 2.6 | 12.3 |
| Sucrose | 10,000 | 0.60 | 4.73 | 1.228 | 0.548 | 7.1 | 23.1 |

*Contains 0.68% organic sulfur.

We claim:

1. In a method for the beneficiation of coal by selective agglomeration wherein raw coal, comprising a percentage of pyritic sulfur as an impurity, is comminuted and thereafter treated with an agglomerant in an aqueous slurry to obtain a coagulum comprising coal particles, the improvement comprising reducing the percentage of pyritic sulfur available for agglomeration in said coagulum by, comminuting the raw coal to a particle size sufficient to provide raw coal particles having a surface area with a ratio of carbonaceous coal to pyritic sulfur impurities which renders particles identifiably hydrophobic or hydrophilic; forming a slurry comprising said raw coal particles and water in a weight ratio of raw coal particles:water of from about 1:5 to about 1:50; treating said slurry with a hydrophilic compound, that forms a hydrophilic colloid with water and is selected from the group consisting of monosaccharide, disaccharide, trisaccharide, polysaccharide starch and gelatin, in an amount sufficient to increase the hydrophilicity of hydrophilic particles dispersed in said slurry without significant effect upon hydrophobic particles dispersed therein; and, thereafter treating said slurry containing impurities of increased hydrophilicity, with sufficient liquid agglomerant to produce a coagulum comprising coal particles having a reduced percentage pyritic sulfur content from the raw coal.

2. The method of claim 1 wherein said hydrophilic compound comprises at least one of gelatin of polysaccharide starch compound.

3. The method of claim 2 wherein said polysaccharide starch compound comprises a nonionic polysaccharide compound.

4. The method of claim 2 wherein said polysaccharide starch compound is of the formula $(C_6H_{10}O_5)_n$ wherein n is greater than about 3.

5. The method of claim 2 wherein said compound comprises a polysaccharide starch.

6. The method of claim 5 wherein said polysaccharide starch is a starch boiled in water at a temperature less than about 120° Centigrade.

7. The method of claim 2 wherein said polysaccharide starch is selected from amylopectin starch, corn starch, pH buffered corn starch, amphoteric corn starch and high amylose content starch.

8. The method of claim 2 wherein said compound comprises less than about 300 ppm of said slurry.

9. The method of claim 8 wherein said compound comprises less than about 250 ppm of said slurry.

10. The method of claim 8 wherein said compound comprises less than about 150 ppm of said slurry.

11. The method of claim 2 wherein said hydrophilic compound comprises gelatin, in an amount less than about 300 ppm in said slurry.

12. The method of claim 1 wherein said hydrophilic compound comprises a disaccharide of the formula $C_{12}H_{22}O_{11}$.

13. The method of claim 12 wherein said disaccharide is selected from sucrose, lactose and maltose.

14. The method of claim 12 wherein said disaccharide comprises above about 400 ppm of said slurry.

15. The method of claim 12 wherein said disaccharide comprises above about 5,000 ppm of said slurry.

16. The method of claim 12 wherein said disaccharide comprises about 10,000 ppm of said slurry.

17. The method of claim 1 wherein said hydrophilic compound is selected from monosaccharide and trisaccharide.

18. The method of claim 17 wherein said saccharide comprises above about 400 ppm of said slurry.

19. The method of claim 2 wherein said hydrophilic compound comprises a polysaccharide starch compound in an amount less than about 300 ppm in said slurry.

20. The method of claim 1 wherein said coal is comminuted to an average particle size less than about 50 microns.

21. The method of claim 20 wherein said coal is comminuted to an average particle size from about 2 to about 40 microns.

22. The method of claim 1 wherein said weight ratio of coal containing particles:water is from about 1:15 to about 1:25.

23. The method of claim 22 wherein said weight ratio of coal containing particles:water is about 1:20.

24. The method of claim 1 wherein said liquid agglomerant is a liquid hydrocarbon.

25. The method of claim 24 wherein said agglomerant comprises at least one of pentane, cyclopentane, hexane, cyclohexane, heptane, decane, tetralin, decalin, fuel oil #1 or fuel oil #6.

26. The method of claim 1 comprising a surface active agent that increases the hydrophobicity of said coal.

27. The method of claim 26 wherein said agent is added to the agglomerating agent prior to treatment of said slurry.

28. The method of claim 26 wherein said agent comprises at least one of octanol or castor oil.

29. The method of claim 1 wherein said impurities comprise at least one of pyrite and ash.

30. A method for reducing the pyrite content of coal comprising, comminuting pyrite containing coal to a particle size sufficient to allow pyrite contained therein to disperse in water; forming a slurry comprising said comminuted coal, water and dispersed pyrite in a weight ratio of coal:water of from about 1:5 to about 1:50; treating said slurry with an amount of at least one of a gelatin or polysaccharide starch compound sufficient to increase the relative hydrophilicity of pyrite dispersed in said slurry to the relative hydrophobicity of said coal; mixing said slurry having increased relative hydrophilicity of pyrite with sufficient liquid agglomerant to form agglomerant coalesced with hydrophobic comminuted coal; and, recovering said agglomerant coalesced with hydrophobic comminuted coal.

31. The method of claim 30 wherein said polysaccharide starch compound comprises less than about 300 ppm of said slurry.

32. The method of claim 30 wherein said polysaccharide starch compound comprises less than about 250 ppm of said slurry.

33. The method of claim 30 wherein said gelatin comprises less than about 300 ppm of said slurry.

34. A method for reducing the pyrite content of coal comprising, comminuting pyrite containing coal to a particle size sufficient to allow pyrite contained therein to disperse in water; forming a slurry comprising said comminuted coal, water and dispersed pyrite in a weight ratio of coal:water of from about 1:5 to about 1:50; treating said slurry with an amount of a mono-, di- or tri- saccharide compound sufficient to increase the relative hydrophilicity of pyrite dispersed in said slurry to the relative hydrophobicity of said coal; mixing said slurry having increased relative hydrophilicity of pyrite with sufficient liquid agglomerant to form agglomerant coalesced with hydrophobic comminuted coal; and, recovering said agglomerant coalesced with hydrophobic comminuted coal.

35. The method of claim 34 wherein said saccharide comprises more than about 400 ppm of said slurry.

36. The method of claim 34 wherein said saccharide comprises more than about 5,000 ppm of said slurry.

37. In a method for the beneficiation of coal by selective agglomeration wherein coal, comprising impurities, is comminuted and thereafter treated with an agglomerant in an aqueous slurry to obtain an agglomerate comprising coal particles, the improvement comprising, comminuting said coal to a particle size sufficient to allow impurities contained therein to disperse in water; forming a slurry comprising said coal and water in a weight ratio of coal:water of from about 1:5 to about 1:40; treating said slurry with a compound comprising at least one of gelatin or polysaccharide, starch compound that in the presence of water is hydrophilic in an amount sufficient to increase the hydrophilicity of impurities dispersed in said slurry; and, thereafter treating said slurry containing impurities of increased hydrophilicity, with sufficient liquid agglomerant to produce a coagulum comprising coal.

38. A method for reducing the pyrite impurity content of coal comprising comminuting the coal to a particle size such that a preponderance of particles have a surface area containing a ratio of coal to impurity which renders the particles respectively hydrophobic or hydrophilic; treating said preponderance of particles in an aqueous slurry with a compound capable of increasing the hydrophilicity of hydrophilic particles; treating the aqueous slurry with an agglomerant having an affinity for hydrophobic particles; and, recovering agglomerated particles.

* * * * *

UNITED STATES PATENT AND TRADEMARK OFFICE

CERTIFICATE OF CORRECTION

PATENT NO. : 5,123,931

DATED : 6/23/92

INVENTOR(S) : R. Good et al

It is certified that error appears in the above-identified patent and that said Letters Patent is hereby corrected as shown below:

Col. 6, lines 1-2 - "(High any loose starch)" should be ---(high amylose starch)---.

Col. 14, line 50 - "polysaccharide, starch compound" should be ---polysaccharide starch compound,---.

Signed and Sealed this

Fourteenth Day of September, 1993

Bruce Lehman

*Attest:*

BRUCE LEHMAN

*Attesting Officer*

*Commissioner of Patents and Trademarks*